US005542661A

United States Patent [19]

Gregan

[11] Patent Number: 5,542,661

[45] Date of Patent: Aug. 6, 1996

[54] TETHERED BALL APPARATUS

[75] Inventor: David C. Gregan, Table View, South Africa

[73] Assignee: OMNICO (PTY) Ltd, Claremont, South Africa

[21] Appl. No.: 273,224

[22] Filed: Jul. 11, 1994

[30] Foreign Application Priority Data

Sep. 8, 1993 [GB] United Kingdom ..... 9318648

[51] Int. Cl.[6] ..... A63B 69/40

[52] U.S. Cl. ..... 273/26 E; 273/200 R; 273/29 A; 273/58 C; 473/147

[58] Field of Search ..... 273/26 E, 29 A, 273/200 R, 58 C

[56] References Cited

U.S. PATENT DOCUMENTS

| | | | |
|---|---|---|---|
| 3,788,297 | 1/1974 | Borst | 273/26 E |
| 4,095,798 | 6/1978 | Marple | 273/58 C |
| 4,964,634 | 10/1990 | Boyer | 273/26 E |
| 5,108,107 | 4/1992 | Shelton | 273/58 C |

FOREIGN PATENT DOCUMENTS

| | | | |
|---|---|---|---|
| 833350 | 4/1960 | United Kingdom . | |
| 2146537 | 4/1985 | United Kingdom | 273/200 R |

*Primary Examiner*—Theatrice Brown
*Attorney, Agent, or Firm*—Larson and Taylor

[57] ABSTRACT

A ball apparatus is provided which includes an anchoring member adapted to be anchored to a supporting surface; a guide member adapted to be held on a supporting surface spaced away from the anchoring member; a cord guide formation associated with the guide member. A cord is attached at one end to the anchoring member and passes through the cord guide formation of the guide member and is attached at its opposite end to a ball. The anchoring member may have a holding formation for holding a resilient ring in position and the cord may be attached to this ring. The ball may be a cricket ball or a baseball ball.

4 Claims, 2 Drawing Sheets

TETHERED BALL APPARATUS

BACKGROUND TO INVENTION

Various types of ball apparatus are known.

It is an object of the invention to provide a novel type of apparatus which can be used to hit a ball for amusement but also for the purpose of practice, e.g. for playing cricket or baseball.

SUMMARY OF INVENTION

According to the invention, a ball apparatus includes a) an anchoring member adapted to be anchored to a supporting surface, the anchoring member being in the form of peg having at least one leg for penetrating into a supporting surface;

b) a ring;

c) a holding formation on the anchoring member for holding said ring in position on said anchoring member and for enabling disengagement of said ring from the anchoring member responsive to the anchoring member being loosened from a supporting surface;

d) a guide member adapted to be held on a supporting surface in spaced relation to the anchoring member, the guide member being in the form of a peg having at least one leg for penetrating into a supporting surface.

e) a cord guide formation associated with the guide member;

f) a ball; and g) a cord made of resilient material, said cord being attached at one end to the ring and passing through the cord guide formation of the guide member and being attached at its opposite end to the ball.

The anchoring peg may be of U-shape having two legs and a cross element, and a bent-in part in each of the legs close to the cross element defining the holding formation for the ring.

The guide peg may be of U-shape having two legs and a cross element, the cord guide formation being defined between the cross element and the legs.

The ring may be an oval ring.

The ring may be made of resilient material, e.g., rubber.

The ball may have an eyelet for attachment of the cord.

The ball may be a cricket ball.

BRIEF DESCRIPTION OF DRAWINGS

The invention will now be described by way of example with reference to the accompanying schematic drawings.

In the drawings there is shown in.

DETAILED DESCRIPTION OF DRAWINGS

Figure 1:
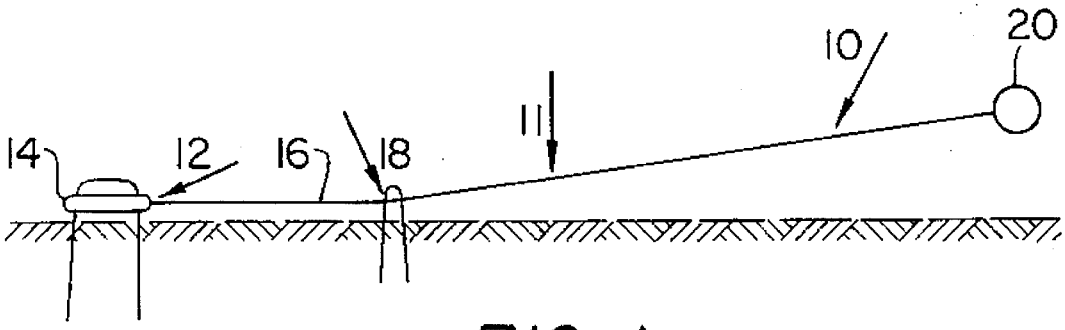
FIG. 1 a side view of a ball apparatus in accordance with the invention and as fitted to a ground surface.
Figure 2:
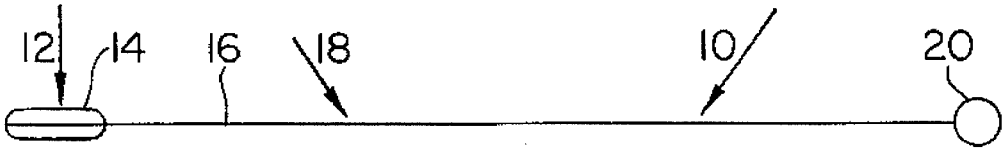
FIG. 2 a plan view seen along arrow II in FIG. 1.
Figure 4:
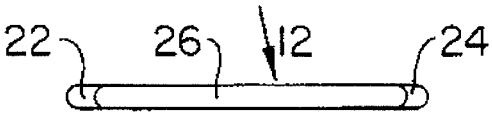
FIG. 4 a plan view seen along arrow IV in FIG. 3.
Figure 3:
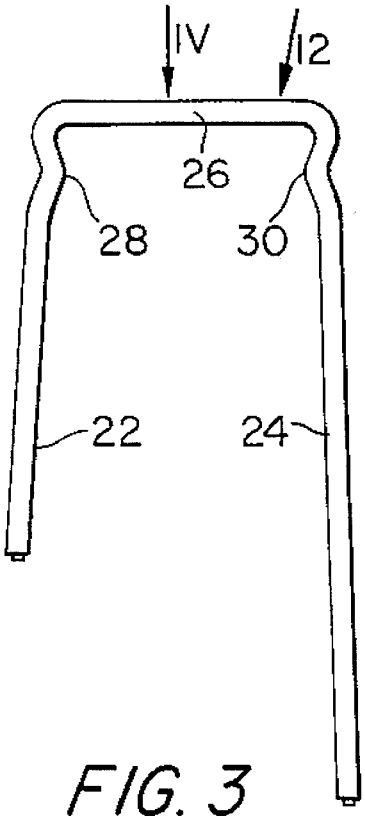
FIG. 3 on an enlarged scale, a side view of the anchoring peg of the apparatus illustrated in FIG. 1 but without its rubber attachment ring.
Figure 5:
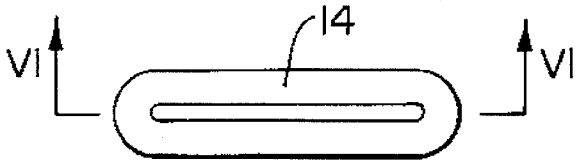
FIG. 5 on an enlarged scale, a plan view of the rubber attachment ring to be fitted to the anchoring peg.

Referring to FIGS. 1 and 2, the ball game apparatus in accordance with the invention, generally indicated by reference numeral 10, includes an anchoring peg 12 supporting a rubber attachment ring 14 to which a flexible cord 16 is attached. The apparatus 10 further includes a guide or safety peg 18 and a ball 20 attached to the free end of the cord 16.

By pulling the ball 20 away from the peg 18 and releasing it, it will fly towards the peg 12 and can be hit by a player, e.g. by means of a baseball bat or any other suitable hitting member.

Referring to FIGS. 3 to 6, the anchoring peg 12 is shown to be of U-shape with two legs 22, 24 and a cross element 26. The legs 22, 24 each have a curved bent part 28, 30 near the cross element 26. The oval rubber ring 14 is fitted into these bent parts 28, 30. The legs 22, 24 of the peg 12 diverge slightly away from the cross element 26.

Figure 6:
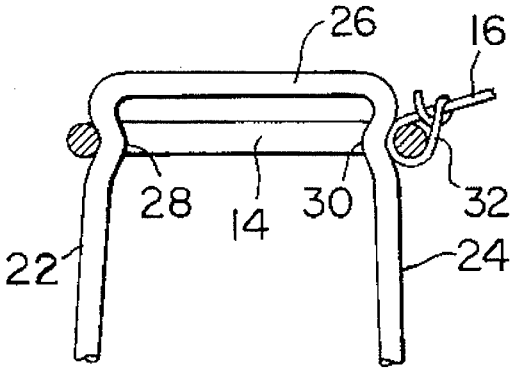
FIG. 6 a sectional side view seen along arrows VI—VI in FIG. 5 but showing the rubber attachment ring as fitted to the anchoring peg.

The cord 16 is attached at its end 32 by being knotted to the ring 14 as shown in FIG. 6.

Figure 7:
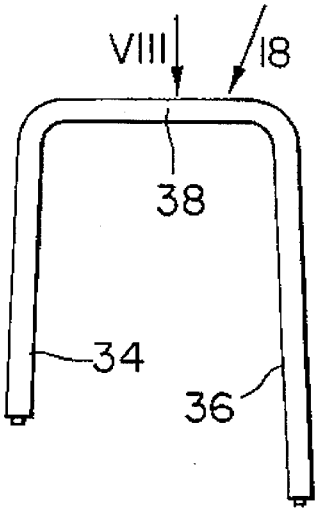
FIG. 7 on an enlarged scale, a side view of the guide or safety peg of the apparatus illustrated in FIG. 1.
Figure 8:
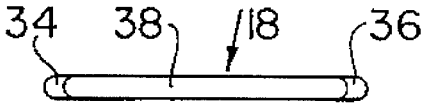
FIG. 8 a plan view seen along arrow VIII in FIG. 7.

As is shown in FIG. 7 and the guide or safety peg 18 is also of U-shape having legs 34, 36 and a cross element 38. The legs 34, 36 of the peg 18 diverge slightly away from the cross element 38.

Figure 9:
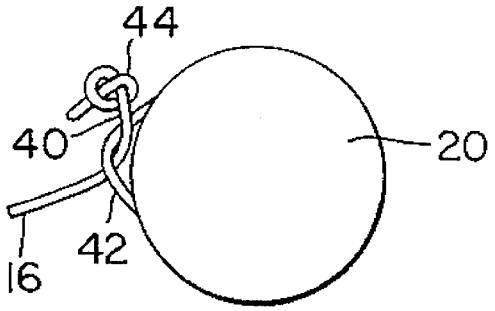
FIG. 9 on an enlarged scale, a side view of the ball of the apparatus illustrated in FIG. 1.

In FIG. 9 it is shown how the end 40 of the cord 16 is attached to the ball 20. The ball 20 has an eyelet 42 and the end 40 is passed through it and a knot 44 is formed to prevent it from being pulled back.

Figure 10:
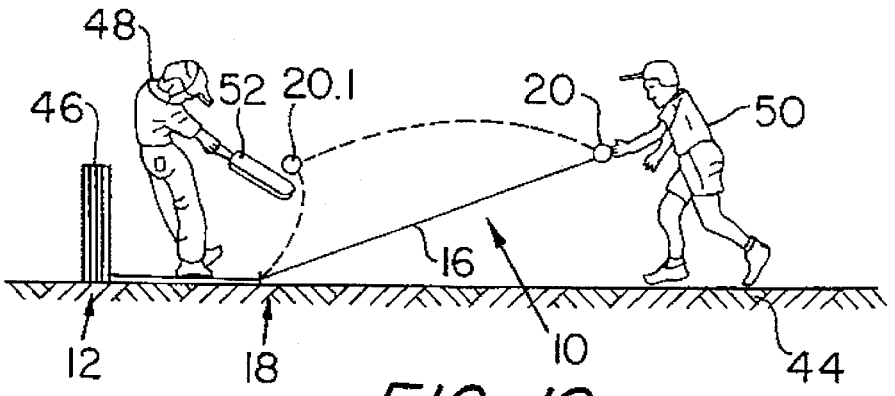
FIG. 10 a side view of the apparatus illustrated in FIG. 1 showing two players in action.

The apparatus 10 is fitted to the ground 44 as shown in FIGS. 1 and 10 by pushing the pegs 12, 18 simply into the ground. The cord 16 then is passed through between the cross element 38 of the peg 18 and the ground 44 and then its end 32 is knotted to the ring 14, which is placed in position in the curved bent parts 28, 30 of the peg 12. The other end 40 of the cord 16 is then attached to the ball 20.

The apparatus 10 can be used as a fun game or as a serious batting practice aid as shown in FIG. 10. It can be played on established lawns as well as hard surfaces, such as brick or concrete surfaces (if the pegs 12, 18 are suitably anchored or if permanent rings are provided in place thereof). It should not be played on loose or sandy soil, e.g. beach sand.

If the pegs 12, 18 are suitably anchored, in the unlikely event of the anchor peg 12 being loosened, the ring 14 will disengage from the peg 12 and then the ring 14 will be moved towards the peg 18, which acts as a safety barrier to prevent the ring 14 from travelling further.

In FIG. 10 it is shown how the apparatus 10 is fitted next to a cricket wicket 46. Two players, a batsman 48 and a bowler 50 are engaged in playing, the bowler 50 pulling the ball 20 and releasing it to allow it to fly towards the batsman 48 into the position 20.1 where it then can be hit by the batsman 48 by means of his cricket bat 52.

Figure 11:
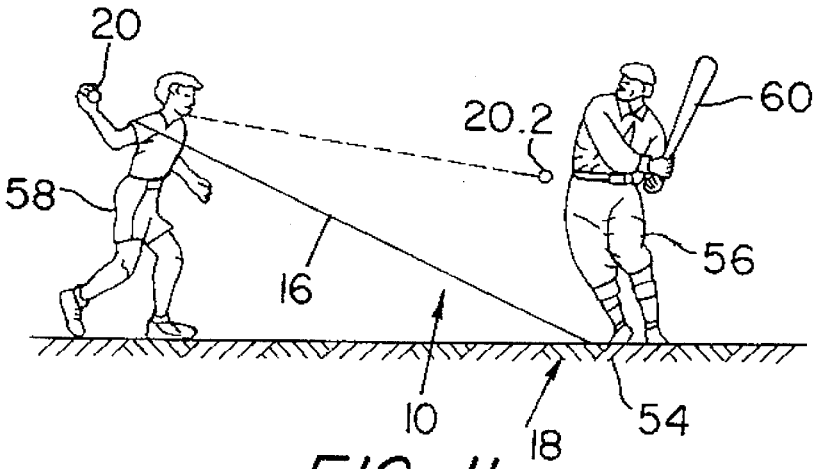
FIG. 11 a view corresponding to FIG. 10 but showing two baseball players in action.

FIG. 11 shows two baseball players in action. The apparatus 10 is fitted on a suitable surface next to a baseball pad 54. A hitter 56 and a thrower 58 are playing, the thrower 58 pulling the ball 20 and releasing it to allow it to fly towards the hitter 56 into the position 20.2 when it then can be hit by the hitter 56 by means of his baseball bat 60.

I claim:

1. A ball apparatus, which includes a) an anchoring member adapted to be anchored to a supporting surface, the anchoring member being in the form of peg having at least one leg for penetrating into a supporting surface;

b) a ring;

c) a holding formation en the anchoring member for holding said ring in position on said anchoring member and for enabling disengagement of said ring from the anchoring member responsive to the anchoring member being loosened from a supporting surface;

d) a guide member adapted to be held on a supporting surface in spaced relation to the anchoring member, the guide member being in the form of a peg having at least one leg for penetrating into a supporting surface;

e) a cord guide formation associated with the guide member;

f) a ball; and g) a cord made of resilient material, said cord being attached at one end to the ring and passing through the cord guide formation of the guide member and being attached at its opposite end to the ball.

2. An apparatus as claimed in claim 1, in which the anchoring member is of U-shape having two legs and a cross element, and a bent-in part in each of the legs close to the cross element defining the holding formation for the ring.

3. An apparatus as claimed in claim 1, in which the guide leg is of U-shape having two legs and a cross element, the cord guide formation being defined between the cross element and the legs.

4. An apparatus as claimed in claim 1, in which the ring is an oval ring and is made of resilient material.

* * * * *